US009076611B2

(12) United States Patent
Cernat et al.

(10) Patent No.: US 9,076,611 B2
(45) Date of Patent: Jul. 7, 2015

(54) CIRCUIT BREAKER UNIT

(75) Inventors: Radu-Marian Cernat, Berlin (DE); Volker Lehmann, Treuenbrietzen (DE); Andrzej Nowakowski, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/348,151

(22) PCT Filed: Sep. 5, 2012

(86) PCT No.: PCT/EP2012/067263

§ 371 (c)(1),
(2), (4) Date: Mar. 28, 2014

(87) PCT Pub. No.: WO2013/045235

PCT Pub. Date: Apr. 4, 2013

(65) Prior Publication Data

US 2014/0209568 A1 Jul. 31, 2014

(30) Foreign Application Priority Data

Sep. 28, 2011 (DE) ..... 10 2011 083 594

(51) Int. Cl.

| | |
|---|---|
| ***H01H 33/04*** | (2006.01) |
| ***H01H 33/70*** | (2006.01) |
| ***H01H 33/91*** | (2006.01) |
| *H01H 33/66* | (2006.01) |
| *H01H 3/60* | (2006.01) |

(Continued)

(52) U.S. Cl.

CPC ..... *H01H 33/04* (2013.01); *H01H 33/66* (2013.01); *H01H 3/60* (2013.01); *H01H 33/7015* (2013.01); *H01H 33/91* (2013.01); *H01H 2009/526* (2013.01); *H01H 2033/888* (2013.01)

(58) Field of Classification Search

CPC ..... H01H 33/04; H01H 33/66
USPC ..... 218/3, 7, 43, 48, 51, 59, 62, 78, 81, 84, 218/116, 117, 118, 119, 120, 134, 135, 154, 218/155, 157

See application file for complete search history.

(56) References Cited

U.S. PATENT DOCUMENTS

| | | | | |
|---|---|---|---|---|
| 1,595,936 | A | 8/1926 | Hilliard | |
| 4,471,187 | A | 9/1984 | Sturzenegger et al. | |
| 5,039,831 | A * | 8/1991 | Sato et al. | 218/144 |

(Continued)

FOREIGN PATENT DOCUMENTS

| | | | |
|---|---|---|---|
| DE | 3009504 | A1 | 6/1981 |
| DE | 102009057703 | A1 | 6/2011 |

(Continued)

*Primary Examiner* — Renee S Luebke
*Assistant Examiner* — Bunyamin Tufan
(74) *Attorney, Agent, or Firm* — Laurence A. Greenberg; Werner H. Stemer; Ralph E. Locher

(57) ABSTRACT

A power circuit breaker unit has first and second arcing contact pieces. A contact gap is formed between the arcing contact pieces. A switch gas channel of the circuit breaker unit joins the contact gap to the surrounding area of the circuit breaker unit for removing a switch gas from the contact gap. Several barriers that increase a flow resistance are arranged successively, spaced from one another, in the switch gas channel. At least one of the barriers is arranged between a first pipe section, which is surrounded by a second pipe section, and the second pipe section.

6 Claims, 1 Drawing Sheet

(51) Int. Cl.
*H01H 9/52* (2006.01)
*H01H 33/88* (2006.01)

(56) References Cited

U.S. PATENT DOCUMENTS

| | | | | |
|---|---|---|---|---|
| 5,939,692 | A * | 8/1999 | Perret | 218/43 |
| 6,018,133 | A * | 1/2000 | Thuries | 218/43 |
| 6,717,791 | B1 | 4/2004 | Wiesinger | |
| 7,402,771 | B2 | 7/2008 | Ye et al. | |
| 8,389,886 | B2 | 3/2013 | Dahlquist et al. | |
| 2008/0197008 | A1 * | 8/2008 | Einschenk et al. | 200/48 R |
| 2008/0290069 | A1 * | 11/2008 | Dufournet et al. | 218/59 |
| 2011/0120975 | A1 * | 5/2011 | Nufer et al. | 218/63 |
| 2011/0163069 | A1 * | 7/2011 | Ohlsson et al. | 218/66 |
| 2012/0261383 | A1 | 10/2012 | Bose et al. | |
| 2013/0056444 | A1 | 3/2013 | Cernat | |

FOREIGN PATENT DOCUMENTS

| | | | |
|---|---|---|---|
| DE | 102010020979 | A1 | 11/2011 |
| EP | 0075668 | A2 | 4/1983 |
| EP | 1105898 | B1 | 9/2002 |
| EP | 1605485 | A1 | 12/2005 |
| EP | 1768150 | A1 | 3/2007 |

* cited by examiner

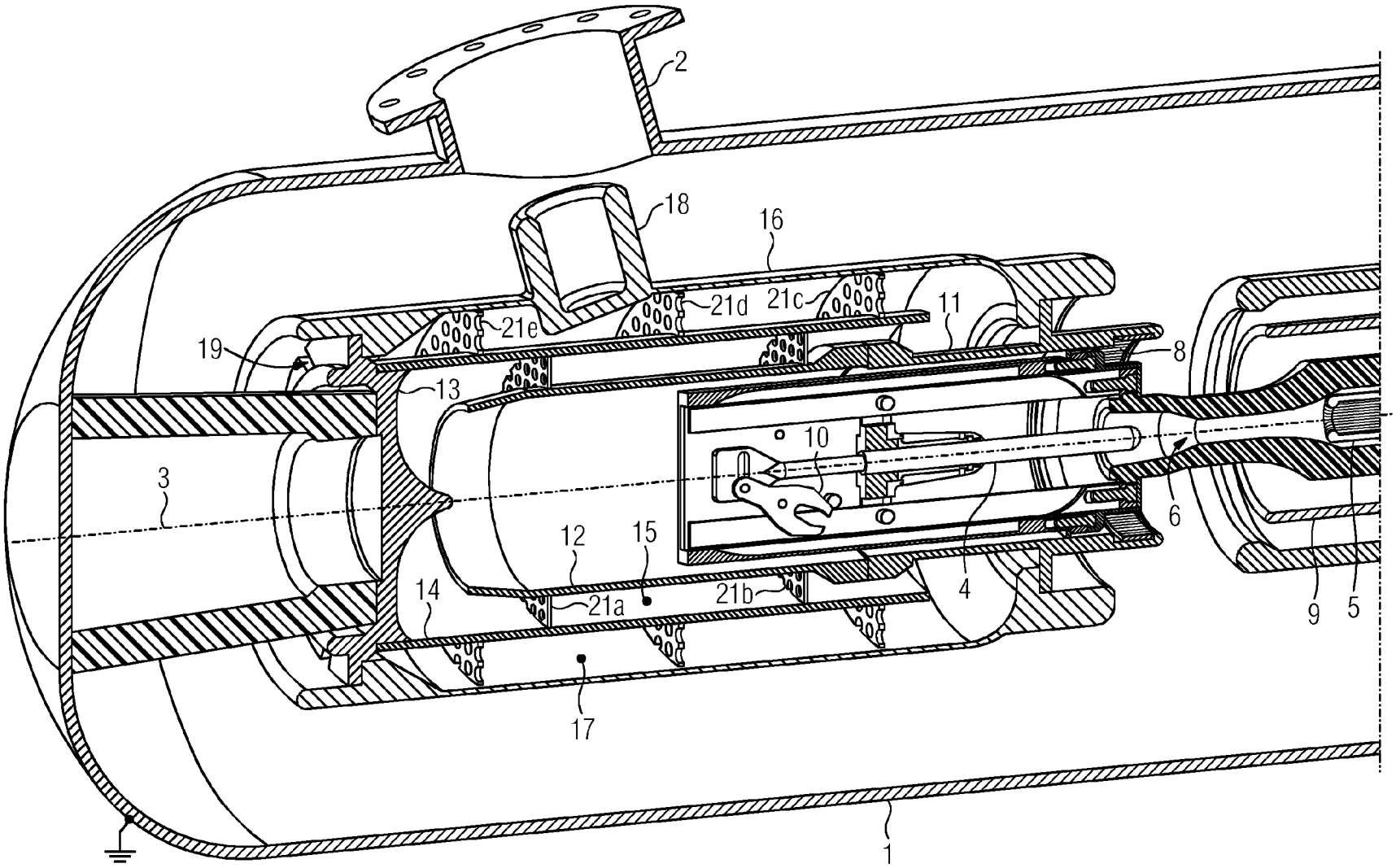
5
9
8
6
4
11
1
10
16
21c
21d
21b
2
18
15
21a
12
17
21e
13
14
19
3

CIRCUIT BREAKER UNIT

BACKGROUND OF THE INVENTION

Field of the Invention

The invention relates to an arrangement comprising a circuit breaker unit having a contact gap that is arranged between a first arcing contact piece and a second arcing contact piece, and having a switching gas channel that connects the contact gap with an environment of the circuit breaker unit, and a barrier that increases a flow resistance of the switching gas channel is arranged in the run of the said switching gas channel.

An arrangement of this type is known by way of example from the European printed patent specification EP 1 105 898 B1. Said patent specification describes a circuit breaker unit that comprises a first arcing contact piece and a second arcing contact piece. A contact gap is arranged between the two arcing contact pieces. The contact gap is connected by way of a switching gas channel to an environment of the circuit breaker unit. In the case of the known construction, the arrangement of a cooling device that comprises openings for switching gases is provided in the run of the switching gas channel. It is intended that the cooling device influences the temperature of a through-flowing switching gas. This cooling device acts as a barrier that increases the flow resistance in the switching gas channel. The known cooling device has a tubular shape and comprises openings for the switching gas in radial directions. A construction of this type renders it possible to allow large quantities of switching gas to pass through the cooling devices within a short time period. In order to ensure sufficient cooling capacity even for large quantities of switching gas, the cooling device needs to have a correspondingly large volume, in particular in the axial direction.

It follows from this that the object of the invention is to provide an arrangement having a circuit breaker unit that in the case of a compact construction renders it possible to effectively cool the switching gas.

BRIEF SUMMARY OF THE INVENTION

In accordance with the invention, the object is achieved in the case of an arrangement of the type mentioned in the introduction by virtue of the fact that a first barrier and a second barrier are arranged within the switching gas channel one after the other at a distance from one another, wherein at least one of the barriers is arranged between a first pipe section and a second pipe section, said first pipe section being encompassed by said second pipe section.

The use of multiple barriers renders it possible to form different sections within the switching gas channel and the switching gas can be retarded in successive different sections in the run of the switching gas channel. It is thus possible to provide by way of example that the flow resistance of the switching gas channel is influenced differently at the first barrier and at the second barrier so that differing amounts of switching gas are retarded at the first barrier and at the second barrier. It is consequently possible in the run of the switching gas channel to alternate between increasing the flow resistance and reducing the flow resistance. These retarding sections that follow one after the other and through which the switching gas flows render it possible to improve the manner in which the switching gas is decelerated or also subsequently accelerated in a purposeful manner. If the arrangement at least of one of the barriers is provided henceforth within an overlapping region of two pipe sections, then the switching gas is automatically retarded in an annular cross section of the switching gas channel. An overlapping arrangement of the pipe sections renders it possible to convey a layered flow of the switching gas. As a consequence, the switching gas flow can be formed in a most laminar manner possible so that on the one hand the switching gas is introduced into the switching gas channel with a small amount of turbulence, but on the other hand the switching gas is purposefully retarded and agitated at the barriers in order subsequently to return to conveying a laminar flow.

If the barrier is used for the purpose of fixing the two pipe sections relative to one another, the barrier can thus be used on the one hand to retard switching gas in the run of the switching gas channel and on the other hand the barrier can be a mechanical supporting component of the circuit breaker unit in order to form the switching gas channel in a compact manner. The barrier can thus be used for the purpose of maintaining a distance between the two pipe sections so that the switching gas channel can be embodied in a defined manner. Furthermore, the barrier can be connected in an angular rigid manner to at least one, in particular two pipe sections so that the pipe sections are fixed relative to one another. The barrier can function as a support element of the circuit breaker unit.

By way of example, an in part overlapping arrangement of the pipes renders it possible for the switching gas to be deflected (if necessary also multiple times) by 180° so that the direction of the flow of the switching gas along the switching gas channel is changed. It is thus possible to provide that the pipe sections are arranged in a concentric manner with respect to one another, wherein the switching gas flows centrally into an inner-lying pipe section in the axial direction and after being deflected in radial directions and then confined by an encompassing pipe section the switching gas flows once more in an axial direction. Thus, an arrangement where the different pipe sections are nestling one within the other forces the switching gas channel into a so-called meandering shape. The meandering shape can be formed in such a manner that in addition the cross section of the switching gas channel is increased in a continuous manner or in steps in the run of the switching gas channel with increasing distance from the contact gap. This can be achieved by increasing the cross sections of the encompassing pipe section(s) in a simple manner in particular where the pipe sections nestle one within the other and are also arranged in a coaxial manner.

The two pipe sections can encompass one another by way of example over their entire length. Openings can be provided on the peripheral face, preferably on the end face, in the encompassing pipe section in order to deflect the switching gas in a radial direction. However, it is also possible to provide that the pipe sections overlap one another merely in part. In the case of an in part overlapping arrangement, it is possible for the second pipe section to encompass the first pipe section in the region of a free end of said first pipe section in order to deflect the switching gas in a radial direction. Thus, it can be provided by way of example that a first pipe section protrudes freely into a second pipe section and is encompassed by the second pipe section, wherein the free end of the first pipe section that protrudes into the second pipe section is arranged at a distance from an impact wall. The switching gas can flow out of the free end of the first pipe section, which protrudes into the second pipe section, against the impact wall where it is deflected in a radial direction and diverted (by changing the direction of the flow of the switching gas) into a section of the switching channel that is formed by means of the overlapping arrangement of the two pipe sections and has an annular cross section.

It is possible to provide in an advantageous manner that the switching gas channel has an annular cross section between the two pipe sections, wherein switching gas can flow through the switching gas channel within the first pipe section and flow within the annular cross section in an opposite direction on the way from the contact gap to a switching gas opening.

An overlapping arrangement of the two pipe sections renders it possible both to define a switching gas channel centrally through the first pipe section and also to form said switching gas channel with an annular cross section in the region where the two pipe sections overlap one another. By virtue of deflection in radial directions, it is possible to achieve a transition from the center cylindrical section of the switching gas channel, which is defined by the first pipe section, into an annular section of the switching gas channel, which is defined between the first pipe section and the second pipe section.

In an advantageous manner, it should be provided that the switching gas channel has a rotationally symmetrical as possible cross section. Thus, pipe sections can be used, by way of example, which have circular contours so that the annular cross section is preferably embodied in the shape of a circular ring. A rotationally symmetrical structure of this type is formed in a dielectrically advantageous manner and also in such a manner as to have a favorable effect on the flow. If a sequence of pipe sections that encompass one another in an azimuthal manner is used henceforth for forming a section of the switching gas channel, the opportunity is thus provided to deflect the switching gas by 180° and to allow said switching gas to flow in the opposite direction along a longitudinal axis, i.e. multiple times along an axially defined region. Pipe sections that follow one another and have different annular cross sections can encompass one another, wherein the switching gas should be deflected once, in particular multiple times, by 180°.

A further advantageous embodiment can provide that at least one of the barriers has a perforated metal plate.

A perforated metal plate is a body that comprises multiple openings that impart the perforated metal plate with a grid-like structure. As a consequence, it is possible to allow switching gas to pass through the openings and simultaneously to produce a mechanical stabilizing arrangement between the pipe sections by way of the webs remaining between the openings in the perforated metal plate. By virtue of connecting the pipe sections one to the other by way of a barrier that is located within an overlapping section of the two pipe sections, it is possible within the run of the switching gas channel to form a region that has an increased flow resistance and wherein by selecting the design of the perforated metal plate it is possible in a purposeful manner to adjust the influence of the flow resistance of said perforated metal plate. Furthermore, by way of its function whereby it influences the flow resistance, the barrier can also fulfill a supporting role within the circuit breaker unit in order to ensure that the pipe sections are connected to one another in a mechanically stable angular rigid manner. In an equivalent manner, it is also possible to use grids or similar devices in lieu of a perforated metal plate.

Furthermore, it is possible to provide in an advantageous manner that at least one annular disc made from a perforated metal plate is inserted as a barrier in a section of the switching gas channel that has an annular cross section.

An annular disc made from a perforated metal plate can be manufactured in a simple manner and can be inserted fitting accurately into a section of the switching gas channel that has an annular cross section between the first pipe section and the second pipe section. It is thus possible by way of example to allow the second pipe section to lie flush against the outer periphery of the annular disc, whereas the first pipe section lies flush against the inner periphery of the annular disc. Consequently, circular contact surfaces that are closed circumferentially are provided both for the first pipe section and also for the second pipe section, by way of which it is possible to provide a connection between the pipe sections in an angular rigid manner. A planar annular disc should be aligned preferably in a transverse manner in particular perpendicular with respect to the flow direction (longitudinal axis) of the switching gas within the switching gas channel. Consequently, it is possible to allow switching gas to flow in a perpendicular manner as possible towards the openings of the perforated metal sheet and out through said openings.

A further advantageous embodiment can provide that the first pipe section and the second pipe section are encompassed by a third pipe section so that two sections that have annular cross sections are formed in the run of the switching gas channel and at least one barrier is arranged in each case in said sections.

The use of a third pipe section renders it possible to allow the switching gas channel to run between three pipe sections that are aligned substantially in a coaxial manner with respect to one another and encompass one another so that it is possible to deflect switching gas at least twice by 180° in the run of the switching gas channel. Accordingly, it is possible to provide the arrangement of a barrier in each of the sections of the switching gas channel that has an annular cross section. In an advantageous manner, it is also possible to arrange multiple barriers in a section that has an almost identical annular cross section. Consequently, a shell-shaped arrangement of the individual pipe sections is provided with respect to one another, wherein a distance remains between the individual shells for the purpose of forming the switching gas channel so that sections of the same switching gas channel encompass one another in the radial sequence. Accordingly, the number of pipe sections can vary so that it is possible in the case of radially extending the circumference to extend the switching gas channel almost as desired, wherein the axial extension remains almost constant.

A further advantageous embodiment can provide that the circuit breaker unit is encompassed by a containing housing.

The circuit breaker is part of the arrangement, wherein furthermore the arrangement can comprise a containing housing. The containing housing can completely encompass the circuit breaker unit so that the circuit breaker unit is completely enclosed by the containing housing. The containing housing can be embodied in such a manner that it is possible to hermetically seal off the immediate environment of the circuit breaker from the environment that surrounds the containing housing. The containing housing can be embodied as a pressure container. As a result, it is possible to fill the containing housing with an insulating fluid, by way of example a compressed gas, in order to ensure the electrically active parts of the circuit breaker are electrically insulated. The circuit breaker can by way of example be supported on the containing housing in an electrically insulated manner. Furthermore, corresponding through passages can be provided at the containing housing in order to route the electrically active parts through the wall of the containing housing into the environment of the containing housing. Through passages of this type can be by way of example so-called open air bushings. The insulating fluid that is located within the containing housing can preferably be pressurized sulfur hexafluoride or nitrogen or mixtures of these substances so that the circuit breaker unit is electrically insulated. However, it is furthermore also possible to provide that the fluid is used to extinguish an arc. Accordingly, it is possible during a switching process for an arc to occur, which generates a so-called switching gas. This switching gas can be generated by way of example by heating the insulating gas or by evaporating materials, such as for example synthetic materials.

In the following, an exemplary embodiment of the invention is illustrated schematically in a drawing and described hereinunder in detail.

BRIEF DESCRIPTION OF THE SEVERAL VIEWS OF THE DRAWING

FIGURE illustrates a sectional view through an arrangement having a circuit breaker unit and a containing housing.

DESCRIPTION OF THE INVENTION

The arrangement comprises a containing housing 1. In this instance, the containing housing 1 is embodied as a pressure vessel that carries at least in sections ground potential. The containing housing 1 has a substantially pipe-shaped structure that is closed at the end faces in each case by a dome-shaped hood. The containing housing 1 comprises multiple flanges of which one exemplary flange 2 is illustrated in the FIGURE. It is possible by means of the exemplary flange 2, by way of example by using a through passage (not illustrated), to introduce a phase conductor in a fluid tight and also electrically insulated manner into the inside of the containing housing 1 for the purpose of making electrical contact with a circuit breaker unit. The containing housing 1 defines a hermetically sealed space that is filled with an electrically insulating gas, in this instance sulfur hexafluoride. The sulfur hexafluoride is arranged at a high pressure in the inside of the containing housing 1. As a result of the hermetically sealed design of the containing housing 1, it is hardly possible under regular conditions for the insulating gas to become sporadically volatile. Electrically conductive sections of the containing housing carry ground potential.

A circuit breaker unit is arranged within the containing housing 1. The containing housing 1 defines the environment of the circuit breaker unit. The circuit breaker unit extends along a longitudinal axis 3. The circuit breaker unit comprises a first arcing contact piece 4 and a second arcing contact piece 5. The two arcing contact pieces 4, 5 are formed in a mutually-opposing manner and can be moved relative to one another along the longitudinal axis 3. A contact gap 6 is formed between the two arcing contact pieces 4, 5. The second arcing contact piece 5 is encompassed by an insulating material nozzle 7 that protrudes in the direction of the first arcing contact piece 4. The first arcing contact piece 4 protrudes in the switched-off state, as illustrated the FIGURE, in part into the insulating material nozzle 7.

The two arcing contact pieces 4, 5 are allocated in each case to a first nominal current contact piece 8 and also to a second nominal current contact piece 9, wherein the first arcing contact piece 4 and the first nominal current contact piece 8 and also the second arcing contact piece 5 and the second nominal current contact piece 9 are permanently connected to one another in an electrically conductive manner so that the mutually allocated arcing contact pieces or nominal current contact pieces 4, 8; 5, 9 respectively always carry an identical electrical potential. The two nominal current contact pieces 8, 9 that are embodied in a mutually opposing manner can be moved relative to one another along the longitudinal axis 3. The two arcing contact pieces 4, 5 are synchronized in their relative movement with respect to a relative movement of the two nominal current contact pieces 8, 9 in such a manner that during a switching-on process the arcing contact pieces 4, 5 make contact earlier than the nominal current contact pieces 8, 9 and during a switching-off process open later than the nominal current contact pieces 8, 9. Consequently, by virtue of the arcing contact pieces 4, 5, the nominal current contact pieces 8, 9 are protected from being eroded by an arc, the reason being is that said arc is preferentially carried on the two arcing contact pieces 4, 5.

In this instance, the first arcing contact piece 4 can be moved in addition by means of a drive mechanism 10 so that both the first arcing contact piece 4 and also the second arcing contact piece 5 respectively can be arranged along the longitudinal axis 3 in such a manner as to be displaceable in opposite directions. In contrast thereto, in the case of the two nominal current contact pieces 8, 9 only the second nominal current contact piece 9 can be moved along the axis 3, whereas the first nominal current contact piece 8 is arranged in a fixed manner relative to the longitudinal axis 3.

The first arcing contact piece 4 is encompassed by a pipe connection 11. The pipe connection 11 is used for the purpose of making contact with and positioning the first nominal current contact piece 8. Furthermore, the pipe connection 11 defines a section of a switching gas channel, wherein during a switching process gas that is generated in the contact gap 6 can be carried out of the contact gap 6 by way of the pipe connection 11. The pipe connection 11 is in this instance arranged in a coaxial manner with respect to the longitudinal axis 3, wherein the pipe connection 11 transforms into a first pipe section 12. The first pipe section 12 essentially assumes the cross section of the section of the switching gas channel that is formed by means of the pipe connection 11, so that the switching gas can also be carried further in the axial direction in the inside of the first pipe section 12 along the longitudinal axis 3. Furthermore, the drive mechanism 10 also protrudes into the first pipe section 12.

The flow deflecting body 13 spans, at a distance, the end of the first pipe section 12, said end being remote from the contact gap 6. The flow deflecting body 13 is connected to a second pipe section 14 that is aligned in a coaxial manner with respect to the longitudinal axis 3. The flow deflecting body 13 closes the second pipe section at the end face, at its end that is remote from the contact gap 6. The second pipe section 14 encompasses the first pipe section 12 at the outer peripheral face so that the first pipe section 12 is encompassed by the second pipe section 14 and the switching gas channel comprises, between the first pipe section 12 and the second pipe section 14, a section that has an annular cross section 15. The second pipe section 14 protrudes at its end that is facing the contact gap 6 freely into the space, wherein the second pipe section 14 is encompassed in turn by a third pipe section 16 so that the switching gas channel has in turn an annular cross section 17 between the second pipe section 14 and the third pipe section 16. The two annular cross sections 15, 17 that are defined by the first pipe section 12 and the second pipe section 14 or by the second pipe section 14 and the third pipe section 16 respectively lie in a coaxial manner with respect to one another and are aligned in a coaxial manner with respect to the longitudinal axis 3, wherein the section of the switching gas channel that has an annular cross section 17 between the second pipe section 14 and the third pipe section 16 encompasses the section of the switching gas channel that has an annular cross section 15 and that is arranged between the first pipe section 12 and the second pipe section 14.

The third pipe section 16 for its part is embodied as a supporting body for the first arcing contact piece 4 and the first nominal current contact piece 8, and is used as a phase conductor for supplying an electrical current to the first nominal current contact piece 8 and to the first arcing contact piece 4.

The flow deflecting body spans, at a distance, the free end of the second pipe section 14 that protrudes in the direction of the contact gap 6 so that the switching gas channel can transform from the section that has an annular cross section 15 between the first pipe section 12 and the second pipe section 14 into the section of the switching gas channel that has an annular cross section 17 between the second pipe section 14 and the third pipe section 16. The flow deflecting body is formed by a circumferential shoulder of the third pipe section 16 that is drawn inwards in the direction of the longitudinal axis 3; the pipe connection 11 or the first nominal current contact piece 8 lie flush against said shoulder and are supported thereby and said shoulder provides a flow path to the first nominal current contact piece 8 or to the first arcing contact piece 4 respectively.

Furthermore, a connector 18 is arranged on the third pipe section 16 on the outer peripheral face. The connector 18 renders it possible to make contact, by way of example of a phase conductor that is introduced by means of an open air bushing by way of the exemplary flange 2, with the first nominal current contact piece 8 and also with the first arcing contact piece 4.

The section that has an annular cross section 17 and is arranged between the second pipe body 14 and also the third pipe body 16 is provided with axial discharge openings 19 at its end that is remote from the contact gap 6. The axial exit openings 19 extend, distributed in a symmetrical as possible manner, around the longitudinal axis 3 so that the switching gas channel is connected by way of the discharge openings 19 to the environment of the circuit breaker unit. The environment of the circuit breaker unit is sealed off by the containing housing 1. The switching gas can pass in the direction of the longitudinal axis 3 into the environment of the circuit breaker unit by way of the discharge openings 19.

In order to support the circuit breaker unit with respect to the containing housing 1, a post insulator 20 in the form of an obtuse, hollow cone is used. The axial discharge openings 19 are arranged in a circumferential manner on the outer peripheral face at the post insulator 20.

The switching gas channel that connects the contact gap 6 upto the discharge openings 19 with the environment of the circuit breaker unit comprises in its run multiple sections that have in each case an annular cross section 15, 17. In order to fix the individual pipe sections 12, 14, 16 with respect to one another, in particular in the radial but also in the axial direction, multiple barriers 21*a*, 21*b*, 21*c*, 21*d*, 21*e* are arranged in the run of the switching gas channel. The barriers are arranged at a distance from one another in the run of the switching gas channel, wherein each of the barriers 21*a*, 21*b*, 21*c*, 21*d*, 21*e* is embodied structurally as an annular perforated metal sheet and encompasses in each case in an azimuthal manner a pipe section and in each case for its part is encompassed in an azimuthal manner by a further pipe section. The different annular cross sections 15, 17 provides the switching gas channel with different sections that are sub-divided by the barriers 21*a*, 21*b*, 21*c*, 21*d*, 21*e*. Accordingly, regions where switching gas is retarded are created at the barriers 21*a*, 21*b*, 21*c*, 21*d*, 21*e*, as a consequence of which switching gas that is flowing out of the contact gap 6 through the switching gas channel in the direction of the discharge openings 19 is retarded, agitated and calmed multiple times. Accordingly, regions where flowing switching gas is retarded are created in a wave-like manner along the switching gas channel, as a consequence of which said flowing switching gas is agitated and cooled in a particularly favorable manner. Furthermore, it is provided that each of the barriers 21*a*, 21*b*, 21*c*, 21*d*, 21*e* is offset in the direction of the longitudinal axis 3 with respect to the other barriers 21*a*, 21*b*, 21*c*, 21*d*, 21*e*. The offset arrangement of the barriers 21*a*, 21*b*, 21*c*, 21*d*, 21*e* renders it possible for the pipe sections 14, 15, 16 to deform in an elastic manner. Consequently, impacts or vibrations can be damped so that impacts between the barriers 21*a*, 21*b*, 21*c*, 21*d*, 21*e* cannot be directly transmitted.

The invention claimed is:

1. A circuit breaker unit assembly, comprising:

a first arcing contact piece and a second arcing contact piece and a contact gap formed between said first and second arcing contact pieces;

a switching gas channel connecting said contact gap to an environment of the circuit breaker unit;

a first pipe section and a second pipe section surrounding said first pipe section and forming at least a part of said switching gas channel;

a plurality of barriers disposed to increase a flow resistance in said switching gas channel, said plurality of barriers including first and second barriers disposed successively at a spacing distance from one another within said switching gas channel, and at least one of said barriers being disposed between said first and second pipe sections.

2. The assembly according to claim 1, wherein said switching gas channel has an annular cross section between said first and second pipe sections, wherein switching gas is enabled to flow through said switching gas channel within said first pipe section and to flow within said annular cross section in an opposite direction on a way from said contact gap to a switching gas discharge opening.

3. The assembly according to claim 2, wherein at least one of said barriers comprises a perforated metal plate.

4. The assembly according to claim 3, wherein at least one annular disc made from perforated metal plate is inserted as a barrier in a section of said switching gas channel that has an annular cross section.

5. The assembly according to claim 1, which comprises a third pipe section encompassing said first pipe section and said second pipe section, forming two flow segments with annular cross sections along a run of said switching gas channel, and wherein at least one of said barriers is disposed in each of said flow segments.

6. The assembly according to claim 1, which comprises a containing housing encompassing a circuit breaker unit formed with said arcing contact pieces, said contact gap, said switching gas channel, said pipe sections and said barriers.

* * * * *